US005380159A

United States Patent [19]

Olsen et al.

[11] Patent Number: 5,380,159

[45] Date of Patent: Jan. 10, 1995

[54] PRESSURE COMPENSATION DEVICE FOR HIGH-PRESSURE LIQUID PUMP

[75] Inventors: John H. Olsen, Vashon; Olivier L. Tremoulet, Jr., Edmonds; Chidambaram Raghavan, Kent, all of Wash.

[73] Assignee: Flow International Corporation, Kent, Wash.

[21] Appl. No.: 261,693

[22] Filed: Jun. 16, 1994

Related U.S. Application Data

[63] Continuation of Ser. No. 73,584, Jun. 7, 1993, abandoned, which is a continuation-in-part of Ser. No. 931,780, Aug. 17, 1992, abandoned.

[51] Int. Cl.[6] ..... F04B 49/08

[52] U.S. Cl. ..... 417/53; 417/278

[58] Field of Search ..... 417/298, 53

[56] References Cited

U.S. PATENT DOCUMENTS

| | | | |
|---|---|---|---|
| 985,013 | 2/1911 | Desmond | 417/298 |
| 1,819,691 | 8/1931 | Rix | 417/298 X |
| 2,065,199 | 12/1936 | Sexton | 137/153 |
| 2,155,236 | 4/1939 | Newell | 417/298 X |
| 2,893,625 | 7/1959 | Gresko | 417/298 X |
| 2,917,225 | 12/1959 | Hanson et al. | 417/298 X |
| 2,971,690 | 2/1961 | Nicholas . | |
| 3,043,496 | 7/1962 | Glass et al. | 417/298 X |
| 3,166,236 | 1/1965 | Michener | 417/298 |
| 4,026,322 | 5/1977 | Thomas | 137/512 |
| 4,371,001 | 2/1983 | Olsen | 137/512.3 |
| 4,389,168 | 6/1983 | Yannascoli et al. | 417/298 |
| 4,536,135 | 8/1985 | Olsen et al. | 417/383 |
| 4,960,340 | 11/1977 | Yanik | 417/298 X |
| 5,037,277 | 8/1991 | Tan | 417/567 |

FOREIGN PATENT DOCUMENTS

| | | |
|---|---|---|
| 484762A1 | 5/1992 | European Pat. Off. . |
| WO82/03337 | 10/1982 | WIPO . |

*Primary Examiner*—Richard E. Gluck
*Attorney, Agent, or Firm*—Seed and Berry

[57] ABSTRACT

A pressure compensation device for use in a high-pressure direct driven pump to control the output pressure of the pump is shown and described. In a preferred embodiment, the high-pressure pump has a valve assembly that selectively allows fluid pressurized by a reciprocating plunger to pass from a pressurization chamber to an outlet chamber from which the pressurized fluid is collected for use. A pressure compensation device has a lever which balances a control force against a force generated by the high-pressure fluid in the outlet chamber. When the outlet pressure exceeds a selected level, the pressure compensation device acts to prevent the further pressurization of fluid by causing the fluid to flow back out of the pressurization chamber via the same passageway(s) through which the fluid was originally introduced into the system.

27 Claims, 6 Drawing Sheets

PRESSURE COMPENSATION DEVICE FOR HIGH-PRESSURE LIQUID PUMP

CROSS-REFERENCE TO RELATED APPLICATION

This application is a continuation of U.S. patent application Ser. No. 08/073,584, filed Jun. 7, 1993, now abandoned, which is a continuation-in-part of U.S. patent application Ser. No. 07/931,780, filed Aug. 17, 1992, now abandoned.

TECHNICAL FIELD

This invention relates to high-pressure, positive displacement liquid pumps, and more particularly, to such pumps including means for controlling the output pressure of the pump.

BACKGROUND OF THE INVENTION

Numerous tasks, for example cutting sheet metal or abrading a surface, may be accomplished through the use of a stream of pressurized fluid, typically water, which is generated by high-pressure, positive displacement pumps. Such pumps pressurize a fluid by having a reciprocating plunger that draws the fluid from an inlet area into a pressurization chamber during an intake stroke, and acts against the fluid during a pumping stroke, thereby forcing pressurized fluid to pass from the pressurization chamber through a passageway to an outlet check valve which selectively allows the pressurized fluid to pass into an outlet chamber. The pressurized fluid in the outlet chamber is then collected in a manifold to be used by an operator via whatever tool has been attached to the pump for a particular task.

During the normal course of operation, the required flow rate will vary from the maximum the pump can supply to zero, for example, when the operator turns the tool off. In this situation, where the pressurized fluid is not being used, the pressure in the outlet chamber will build up beyond an acceptable level unless some form of pressure control is incorporated into the pump. If no pressure control is provided, the buildup of high pressure will result in damage and stress to the parts of the pump and undesirable surges of pressure will occur when the operator again turns the tool on.

One method of pressure control which is currently used is to incorporate a relief valve into the pump. When the pressure in the outlet chamber rises above a preset limit as a result of pressurizing more water than is demanded by the end user, the relief valve opens to vent the excess pressurized fluid. This method has several disadvantages, however. Perhaps most significantly, it is very expensive and inefficient to pressurize water thereby generating potential energy, only to throw it away. This throwing away of energy results in increased maintenance and fuel costs. This method of controlling output pressure is also undesirable because of the large quantity of water that is thrown away as waste, rather than being used.

Another method considered in the course of developing the present invention for controlling the output pressure of the pump, which is substantially equivalent to the pressure in the outlet chamber, is to choke off the flow at the inlet. However, this method causes the fluid to cavitate, which results in significant damage to the pump. Such damage in turn increases the "down time" of the machine and increases cost of operation, both in labor and replacement parts. This method also causes the system to have a large time constant, which results in undesirable pressure oscillations.

SUMMARY OF THE INVENTION

It is therefore an object of this invention to provide a pressure control or compensation device for use in a high-pressure pump that will increase the energy efficiency of the pump by pressurizing only as much water as is required by an end user.

It is another object of this invention to provide a pressure compensation device for use in a high-pressure pump that will increase the life of the pump components by maintaining a substantially constant level of pressure.

It is another object of this invention to provide a pressure compensation device for use in a high-pressure pump that will minimize the waste of water.

It is another object of this invention to provide a pressure compensation device for use in a high-pressure pump that will reduce fuel consumption and wear on parts due to cavitation and pressure surges.

These and other objects of the invention, as will be apparent herein, are accomplished by providing a high-pressure pump having a pressure compensation device. In a preferred embodiment, a high-pressure pump is provided having the same elements and operating in the same manner as described above, which detects a force generated by high-pressure fluid in the outlet chamber and balances this force against a reference, or control force. In the preferred embodiment illustrated herein, the reference force is generated by the use of a reference gas or fluid pressure acting over a piston of defined surface area. It will be appreciated by one of ordinary skill in the art that in alternative embodiments, the control force may be generated by a spring or other mechanical mechanism, an electrical device or any other method of force generation.

In the preferred embodiment described herein, when the pressure in the outlet chamber exceeds a selected level, which may be changed by adjusting the reference or control pressure, the pressure compensation device forces the inlet check valve open which allows the fluid in the pressurization chamber to flow back out of the pressurization chamber into the inlet area, thereby preventing the pressurization of any unneeded fluid.

More specifically, in the preferred embodiment described herein the pressure compensation device has three pins, an outlet pin, an inlet pin, and a compensation pin, each of the three pins having a first and a second end. The first end of the outlet pin is in contact with and therefore acted upon by the pressurized fluid in the outlet chamber. This action causes the second end of the outlet pin to exert a force against a lever of the compensation device. This force generated by the pressurized fluid is balanced by a force generated by the action of a control pressure acting against the first end of the compensation pin, which causes the second end of the compensation pin to exert a force on the lever. The geometry of the pressure compensation device is such that the pressure in the outlet chamber must be several magnitudes greater than the control pressure to balance the lever. When the pressure in the outlet chamber exceeds the selected level such that the force from the pressurized fluid overcomes the force from the control pressure, the lever rotates, thereby acting on the first end of the inlet pin, the second end of the inlet pin being in contact with the inlet check valve such that the rotation of the lever forces the inlet check valve open.

When the inlet check valve is thus held open, the fluid in the pressurization chamber during the pumping stroke of the plunger will take the path of least resistance, thereby exiting back out of the pressurization chamber the way it came in, rather than being directed toward the outlet check valve.

When the pressure in the outlet chamber again falls below the desired level, the two forces from the pressurized fluid and the control pressure, respectively, will again balance the lever, thereby allowing the inlet check valve to close.

DETAILED DESCRIPTION OF THE INVENTION

Figure 1:
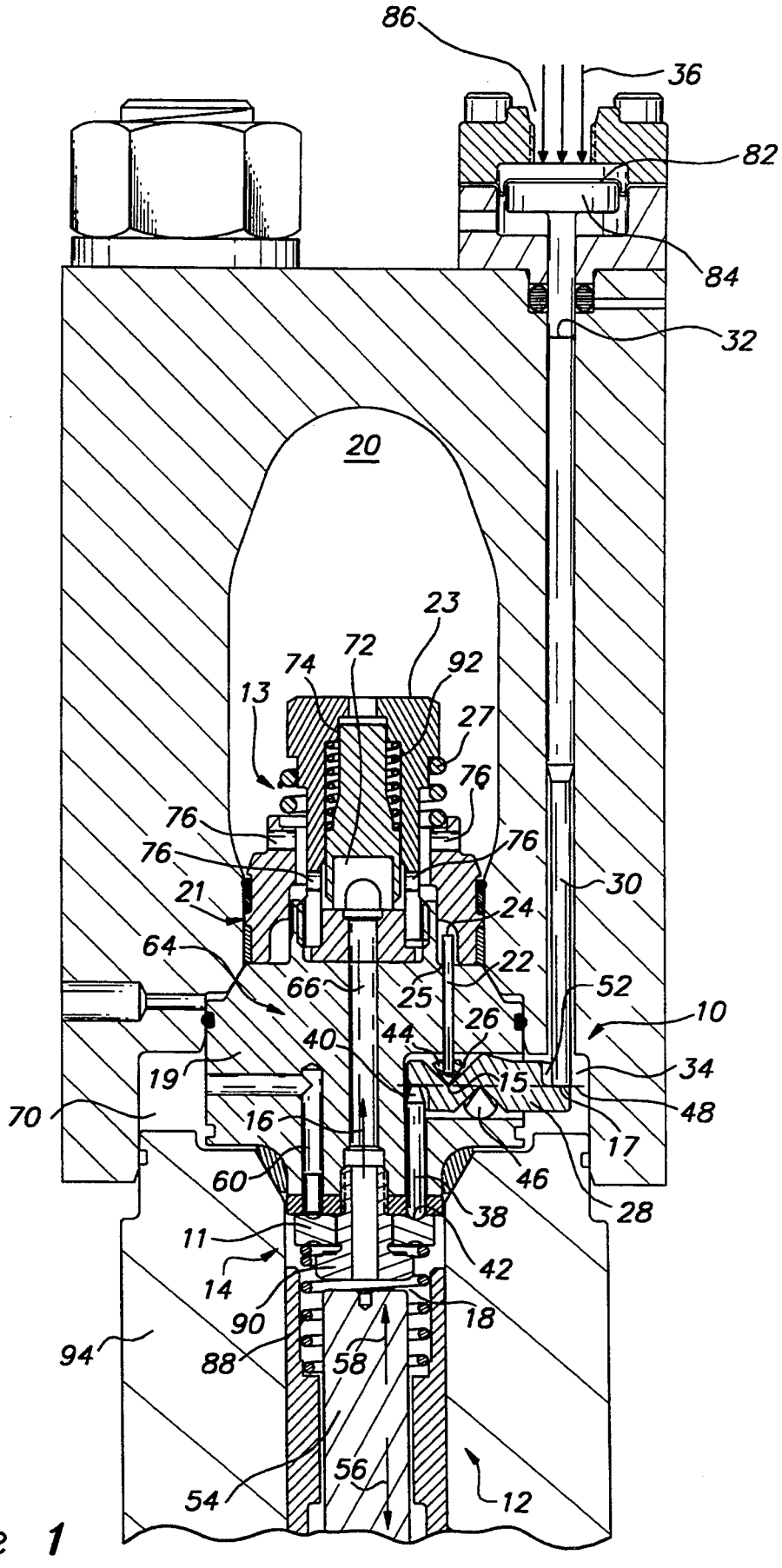
FIG. 1 is a cross-sectional top plan view of a preferred embodiment of the present invention illustrating a pressure compensation device incorporated into a high-pressure pump under conditions where the output pressure has not exceeded a desired level.
Figure 4:
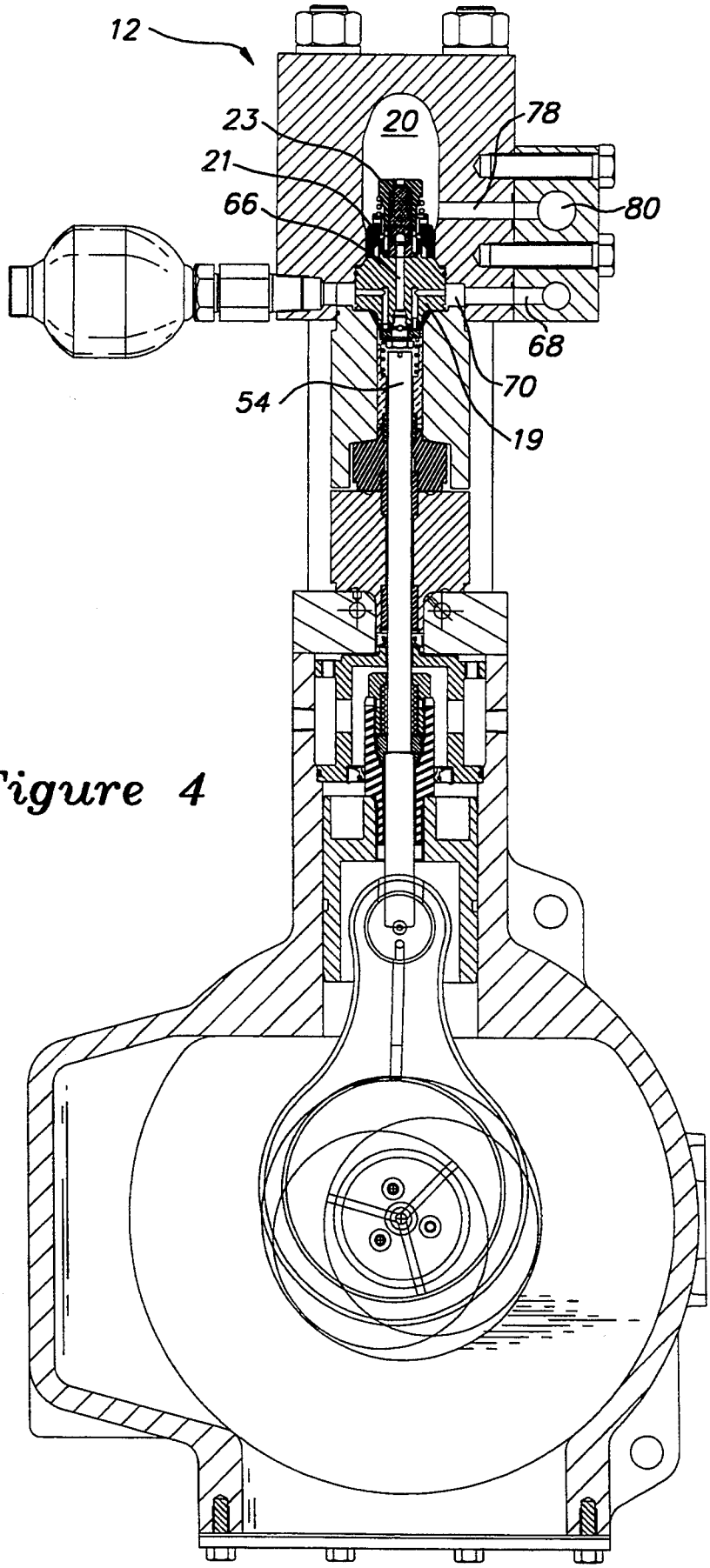
FIG. 4 is a cross-sectional plan view taken on line 4—4 of FIG. 3.

FIGS. 1 and 4 illustrate a preferred embodiment of the present invention. A direct drive motor (not shown) causes a plunger 54 of a high-pressure pump, or pump head 12 to reciprocate within a pressurization chamber 18. The action of the reciprocating plunger 54 will cause fluid to be drawn into the pressurization chamber 18 during an intake stroke and to be pressurized and forced out of the pressurization chamber 18 into an outlet chamber 20 during a pumping stroke. The pressurized fluid is selectively allowed to pass from the pressurization chamber 18 to the outlet chamber 20 by a valve assembly 64, having an inlet check valve 14 and an outlet check valve 13 connected via a passageway 66. The pressurized fluid passes from the outlet chamber 20 to a manifold 80, where it is collected for use by an operator.

It is desirable to maintain a constant pressure in the outlet chamber 20, this pressure being substantially equivalent to the output pressure of the pump 12, regardless of the flow rate. This is accomplished through use of a pressure compensation device 10 which senses the pressure in the outlet chamber 20 and balances a force generated by this pressure against a resultant force from a fluid control pressure 36, the geometry of the pressure compensation device 10 being such as to allow a fluid control pressure 36 to balance a pressure in the outlet chamber 20 that is several magnitudes larger. When the pressure in the outlet chamber 20 exceeds a preselected level, the pressure compensation device 10 acts to prevent further pressurization of fluid in the pressurization chamber 18 by causing the fluid in the pressurization chamber 18 to flow back out of the pressurization chamber 18 via a plurality of inlet ports 60 through which the fluid was originally introduced into the system.

Figure 2:
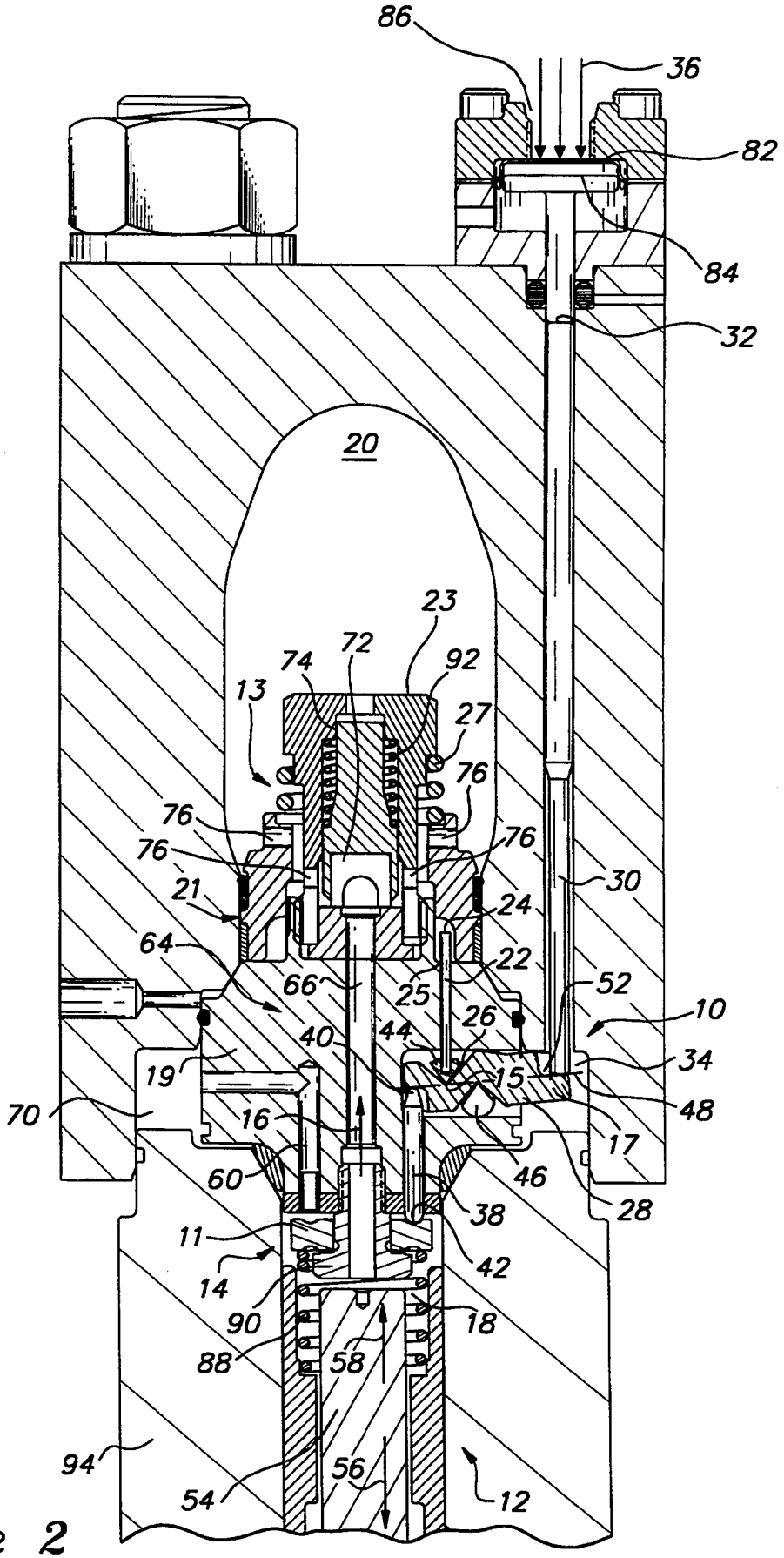
FIG. 2 is a cross-sectional top plan view of the pressure compensation device of FIG. 1 under conditions where the output pressure has exceeded a desired level.

More specifically, as illustrated in FIG. 1, the high-pressure pump 12 has a plunger 54 which reciprocates within a cylinder 94, the plunger 54 having an intake stroke and a pumping stroke, the direction of the two strokes being represented schematically in FIGS. 1 and 2 by arrows 56 and 58, respectively.

The high-pressure pump 12 further includes a valve assembly 64, comprised of an inlet check valve 14 and an outlet check valve 13, the two check valves 13 and 14 being connected via a passageway 66. The valve assembly 64 is substantially contained within a check valve body 19 and a cap seal assembly 21, the cap seal assembly 21 being held against the valve body 19 by compression spring 27.

As illustrated in FIGS. 1 and 2, the inlet check valve 14 includes a valve element 11 and an inlet retaining screw 90 which allows limited movement of the valve element 11. The passageway 66 extends through the inlet retaining screw 90 into a pressurization chamber 18. The inlet check valve 14 is urged into a closed position by the inlet compression spring 88. The outlet check valve 13 includes a poppet 72 and a poppet guide 74 which restricts the movement of the poppet 72. The poppet guide 74 is mounted within a cage 23, and the outlet check valve 13 is urged into a closed position by outlet compression spring 92.

When the inlet check valve 14 is closed, a volume of pressurized fluid is forced to pass from the pressurization chamber 18 through the passageway 66 to the outlet check valve 13, the outlet check valve 13 selectively allowing pressurized fluid to pass from the passageway 66 into the outlet chamber 20, as will be discussed in greater detail below.

For purposes of discussion, it will first be assumed that the output pressure, or pressure in the outlet chamber 20, is at or below a desired level, this outlet pressure being user selectable as will also be discussed in greater detail below. Operation of the pump under this assumed condition is illustrated in FIG. 1.

During the intake stroke 56 of the plunger 54, the inlet check valve 14 is pulled into an open position to a sufficient degree to allow a volume of fluid, typically water, being provided via the supply pipe 68, shown in FIG. 4, to pass through the inlet area 70 and through the inlet ports 60 into the pressurization chamber 18. The fluid is at a relatively low pressure, for example, 100–300 PSI. Although a varying number of inlet ports may be used, including only one, in the preferred embodiment illustrated herein, five inlet ports 60 provide fluid to the pressurization chamber 18, the inlet ports 60 being spaced radially around the passageway 66.

Figure 3:
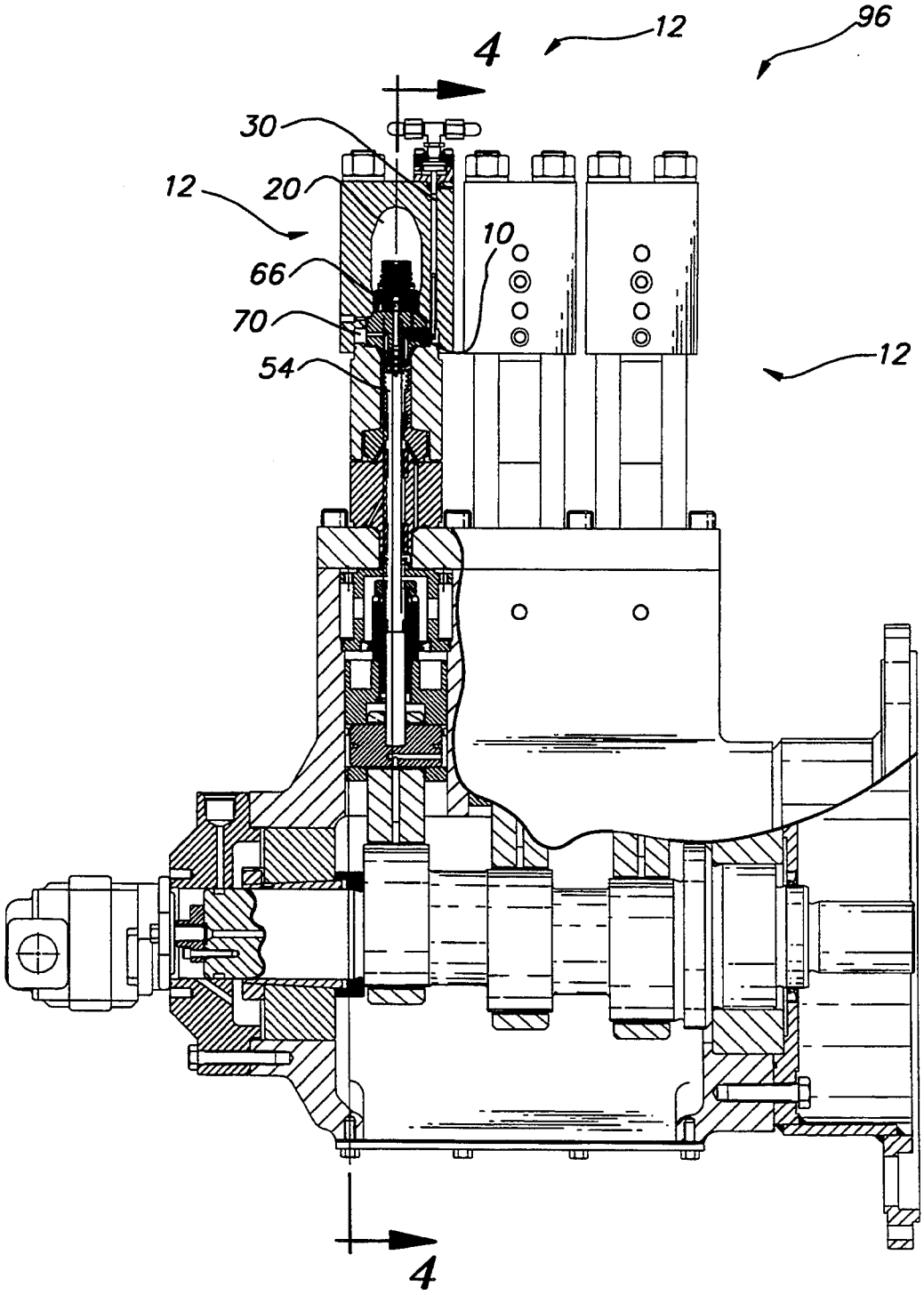
FIG. 3 is a top plan view of a pump assembly utilizing three of the high-pressure pump heads and compensation devices shown in FIGS. 1 and 2.

During its pumping stroke 58, the plunger 54 acts against the fluid, thereby compressing, or pressurizing it and forcing it towards the inlet check valve 14. Given the assumed operating condition, the inlet check valve 14 is forced into a closed position such that it closes off the inlet ports 60. The now pressurized fluid passes through passageway 66 to the outlet check valve 13, where the pressure increases until it is sufficient to open the poppet 72 of the outlet check valve 13. The pressure developed may be up to and beyond 40,000 PSI. The pressurized fluid then flows around poppet 72 through discharge ports 76 and through outlet compression spring 92 into the outlet chamber 20. From outlet chamber 20, the pressurized fluid passes through the discharge pipe 78 to a manifold 80, shown in FIG. 4, where the pressurized fluid is collected and used by an operator via a tool selected for a particular job. The manifold 80 is designed to accept the flow from a multitude of heads, as determined by the overall desired output of a pump assembly. A pump assembly 96, utilizing three high-pressure pump heads 12 as illustrated in FIGS. 1 and 2, is illustrated in FIG. 3.

The need for a pressure compensation device 10 embodying the present invention becomes apparent when considering a change in operating conditions. For example, the operator may turn off the tool previously in use, thereby reducing the flow rate to zero. As discussed previously, it is desirable to have a compensation device which will maintain a substantially constant pressure in the outlet chamber 20 without throwing away energy or water. To illustrate how this is achieved in the preferred embodiment illustrated herein, FIG. 2 shows the configuration of the pressure compensation device 10 under an operating condition where the pressure in the outlet chamber 20 has exceeded a desired level.

As shown in FIGS. 1 and 2, the pressure compensation device 10 has a lever 28 which pivots about a knife-edge bearing 46. The knife-edge bearing 46 is preferably used in this environment because pressure control can be optimized by minimizing the friction between the machine elements. The pressure compensation device 10 further includes three pins, namely a compensation pin 30, an outlet pin 22, and an inlet pin 38. The three pins 30, 22 and 38 all preferably act on the center line of the lever 28 because by doing so, undesirable lateral movement of the pin ends perpendicular to the pin centerlines is minimized.

The first end 24 of the outlet pin 22 passes through an opening 25 in the check valve body 19 such that the outlet pin 22 is exposed to the pressurized fluid in the outlet chamber 20. In a preferred embodiment the first end 24 of outlet pin 22 is no more than 1–1.5 ten-thousandths of an inch smaller than the opening 25 in the check valve body 19 to prevent the leakage of pressurized fluid from the outlet chamber 20. This action of the pressurized fluid against the first end 24 of the outlet pin 22 causes the second end 26 of the outlet pin 22 to exert a force against the lever 28 at a point 15. As illustrated in FIGS. 1 and 2, the second end 26 of the outlet pin 22 is preferably a knife-edge chisel 44, which serves to reduce friction between the outlet pin 22 and the lever 28, thereby optimizing pressure control as discussed above. It will be appreciated by one of ordinary skill in the art that the second end 26 of the outlet pin 22 may be formed into a knife-edge bearing or chisel or attached to a separately formed knife-edge chisel.

Figure 5:
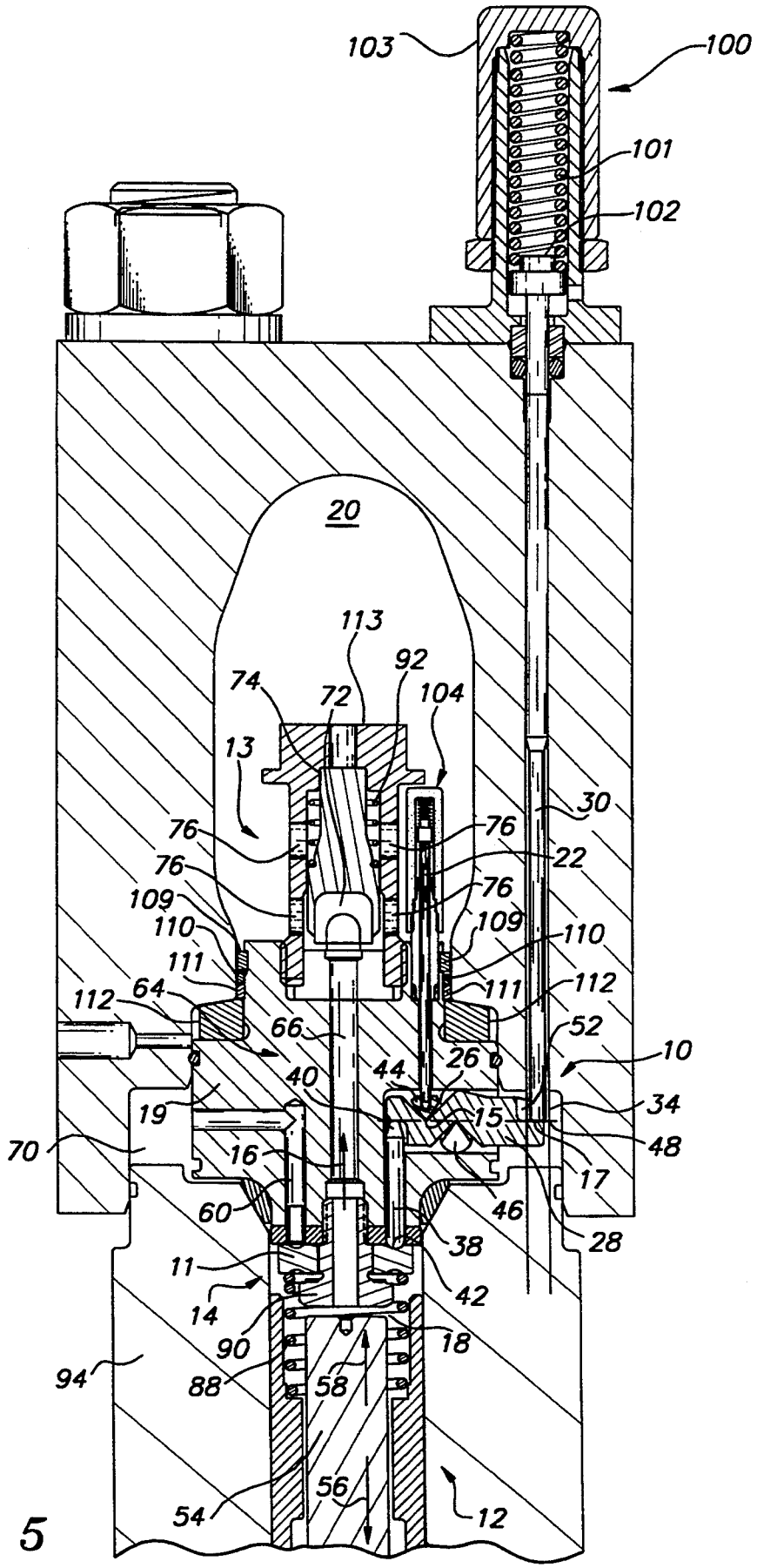
FIG. 5 is a cross-sectional plan view of an alternative embodiment of the pressure compensation device of FIG. 1.
Figure 6:
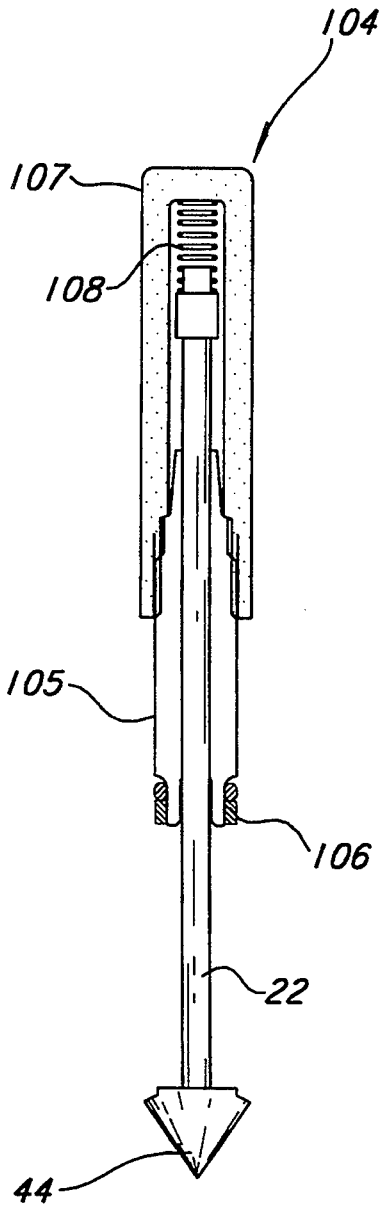
FIG. 6 is an enlarged cross-sectional plan view of an element of the pressure compensation device of FIG. 5.

In a preferred, alternative embodiment illustrated in FIG. 5, outlet pin 22 is contained within compensator actuator cartridge 104. As illustrated in FIG. 6, cartridge 104 is held in place by cage 113 and includes sleeve 105 through which outlet pin 22 passes. A seal 106 is provided between the sleeve 105 and check valve body 19 to prevent any leakage at that interface. In the embodiment illustrated in FIG. 5, the interface between check valve body 19 and the end cap is sealed by split keeper ring 109, o-ring 110, polymer seal 111 and a back up ring 112.

By containing outlet pin 22 in cartridge 104, manufacturing is simplified and precise tolerances may be achieved between the outer diameter of the outlet pin and the inner diameter of the sleeve 105. This is critical to prevent leakage of pressurized fluid from the outlet chamber 20, because leakage from the system increases dramatically with even minor increases in tolerances. In addition, by providing a precision hole and pin 22 in cartridge 104, the assembly is easily replaceable. As further illustrated in FIG. 6, a spring 108 maintains the outlet pin 22 and knife edge chisel 44 in proper position relative to each other and lever 28, and a filter 107 is provided to prevent contaminants in the pressurized fluid from reaching the interface between the outlet pin 22 and sleeve 105. In a preferred embodiment, the filter is made of sintered stainless steel.

As illustrated in FIGS. 1 and 2, the first end 32 of the compensation pin 30 is acted upon by a fluid control pressure 36 through compensation port 86. The fluid control pressure 36 exerts a force against the diaphragm 82 and piston 84, causing the second end 34 of the compensation pin 30 to exert a control force against the lever 28 at point 17. The geometry of the pressure compensation device 10 is such that the lever 28 will be balanced when the pressure in the outlet chamber 20 is 500 times the control pressure exerted on the diaphragm 82.

It will be understood by one of ordinary skill in the art that the force generated by the pressurized fluid in the outlet chamber 20 may also be balanced by a direct control force (not shown) rather than by a fluid control pressure 36 acting on a piston 84. Such a direct control force may be generated, for example, by a spring or other mechanical mechanism, an electrical device or any other method of force generation. In an alternative embodiment illustrated in FIG. 5, a direct control force is generated by spring actuator 100, wherein a spring 101 is used to apply a force through piston 102, causing compensation pin 30 to exert a control force against the lever 28. The spring force may be adjusted by rotating cap 103.

The second end 34 of the compensation pin 30 is preferably narrowed such that it is not in contact with the opening 52 provided in the lever 28 to receive the compensation pin 30 because by doing so, the compensation pin 30 is free to flex sufficiently as the lever 28 rotates to prevent the compensation pin 30 from sliding against lever 28. This design further serves to reduce friction and improve pressure control.

The fluid control pressure 36 may be provided by any suitable fluid, for example, water or air, and may be adjusted by the operator with the turn of a knob. Adjusting the control pressure therefore "sets" the output pressure given that a different control pressure requires a different pressure in the outlet chamber 20 to balance the lever. For example, if the fluid control pressure 36 is set to 80 PSI at compensation port 22, a fluid pressure of 40,000 PSI in the outlet chamber 20 acting on outlet pin 22 will balance the lever 28. It will be appreciated by one of ordinary skill in the art, that the geometry may be changed to result in a mechanical advantage of different ratios, for example, 400:1, meaning that a fluid control pressure 36 of 80 PSI would require a fluid pressure of 32,000 PSI in the outlet chamber 20 to balance the lever 28. In the preferred embodiment, however, as noted above, the mechanical advantage is set for 500:1.

For purposes of explanation, assume that the pressure in the outlet chamber 20 is "set" at 40,000 PSI by a fluid control pressure 36 of 80 PSI, and the pressure in the outlet chamber 20 has exceeded 40,000 PSI, for example if the operator has turned the tool he is using off. Given the geometry of the pressure compensation device 10, the force generated by the action of the pressurized fluid in the outlet chamber 20 acting on the first end 24 of the outlet pin 22 will overcome the control force generated by the action of the fluid control pressure 36 acting on the first end 32 of the compensation pin 30. As a result, the lever 28 will pivot about knife-edge bearing 46 in a counterclockwise direction, as illustrated in FIG. 2, thereby pushing on the first end 40 of the inlet pin 38. In turn, the second end 42 of the inlet pin 38 which is in contact with the valve element 11 of the inlet check valve 14, will force the inlet check valve 14 into an open position, or, if the inlet check valve is already open, as it is during the intake stroke 56 of the plunger 54, the second end 42 of the inlet pin 38 will act as a stop, thereby preventing the inlet check valve 14 from closing. Given this condition, the fluid which is forced toward the inlet check valve 14 by the plunger 54 during its pumping stroke 58 will flow back out of the pressurization chamber 18 through the inlet ports 60, rather than through the passageway 66 towards the outlet chamber 20. The pressure in the outlet chamber 20 is therefore maintained at a substantially constant level, without throwing away water or potential energy. As long as the force generated by the pressurized fluid in the outlet chamber 20 is sufficient to overcome the control force, the inlet check valve 14 will be forced into an open position.

Although in the preferred embodiment described herein, recirculation of fluid to prevent pressurization of unneeded fluid is achieved by holding open the inlet check valve 14 thereby causing the fluid in the pressurization chamber 18 to flow back out into the inlet area 70, the same results may be achieved by allowing the fluid in the pressurization chamber 18 to flow into an alternative chamber or passageway to subsequently be recirculated through the inlet area 70. Similar results of the inventive concept described herein may also be accomplished by forcing the outlet check valve 13 open when the pressure in the outlet chamber 20 exceeds a desired level, thereby allowing pressurized fluid to escape from the outlet chamber 20 to be recirculated.

When the pressure in the outlet chamber 20 falls to or below the desired level, in our example 40,000 PSI, the lever 28 will again balance, allowing the inlet check valve 14 to return to a closed position, for operation to resume as described above under the condition that the pressure in the outlet chamber 20 is at or below a desired level.

The preferred embodiment of the pressure compensation device described herein has a fast response rate, or low time constant, enabling it to adjust for changes in pressure within $\frac{1}{3}$ of a revolution of the pump. This arrangement is believed advantageous for most applications because a fast response rate further serves to optimize pressure control accuracy.

A pressure compensation device for use in a high-pressure pump to control the output pressure of the pump has been shown and described. From the foregoing, it will be appreciated that, although embodiments of the invention have been described herein for purposes of illustration, various modifications may be made without deviating from the spirit and scope of the invention. Thus, the present invention is not limited to the embodiments described herein, but rather is defined by the claims which follow.

We claim:

1. A high-pressure pump comprising:

a pressurization chamber;

a plunger coupled to the pressurization chamber for reciprocation within the pressurization chamber, the plunger having an intake stroke and a pumping stroke;

at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that pressurized fluid may pass from the pressurization chamber to the outlet check valve, the outlet check valve selectively allowing the pressurized fluid to pass to an outlet chamber; and a pressure compensation device including an outlet pin having a first end and a second end, the second end of the outlet pin exerting a force upon a lever when the first end of the outlet pin is acted upon by the pressurized fluid in the outlet chamber, a compensation pin having a first end and a second end, the second end of the compensation pin exerting a control force on the lever when the first end of the compensation pin is acted upon by a control pressure, and an inlet pin having a first end and a second end, the first end of the inlet pin being in contact with the lever, the second end of the inlet pin being in contact with the inlet check valve, wherein the force from the compensation pin acting on the lever is balanced by the force from the outlet pin acting on the lever, and wherein an increase in pressure of the pressurized fluid in the outlet chamber above a preset level causes the outlet pin to exert a force on the lever that overcomes the force exerted by the compensation pin on the lever, thereby causing the lever to pivot and act upon the first end of the inlet pin, such that the second end of the inlet pin holds the inlet check valve open, thereby preventing further pressurization of the fluid in the pressurization chamber.

2. The high-pressure pump according to claim 1 wherein the outlet pin passes through a sleeve of a compensator actuator cartridge wherein a tolerance between the outlet pin and the sleeve is no more than three ten-thousandths of an inch.

3. The high-pressure pump according to claim 1 wherein the second end of the outlet pin is a first knife-edge bearing and the lever pivots about a second knife-edge bearing, thereby reducing friction.

4. The high-pressure pump according to claim 1 wherein the lever is configured such that the compensation pin, the outlet pin, and the inlet pin all act on a common center line of the lever.

5. The high-pressure pump according to claim 1 wherein the fluid pressure in the outlet chamber may be set to a user-selected level by adjusting the control pressure.

6. The high-pressure pump according to claim 1 wherein the lever is provided with an opening to receive the second end of the compensation pin and a diameter of the second end of the compensation pin is smaller than the opening in the lever and the compensation pin has an ability to flex such that when the lever pivots, the compensation pip does not slide in a lateral direction and friction between the compensation pin and the lever is reduced.

7. A high-pressure pump comprising:

a pressurization chamber;

a plunger coupled to the pressurization chamber for reciprocation within the pressurization chamber, the plunger having an intake stroke and a pumping stroke;

at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that pressurized fluid may pass from the pressurization chamber to the outlet check valve, the outlet check valve selectively allowing the pressurized fluid to pass to an outlet chamber; and a pressure compensation device coupled to the inlet check valve, the pressure compensation device having a first pin provided in direct contact with the pressurized fluid in the outlet chamber and being balanced against a control pressure, the pressure compensation device having a second pin coupled to the inlet check valve and to the first pin, such that when a force generated by the pressurized fluid in the outlet chamber overcomes a force generated by the control pressure, the first pin acts against the second pin such that the second pin holds the inlet check valve open, thereby preventing the passing of fluid from the pressurization chamber to the outlet chamber and the pressurization of fluid.

8. The high-pressure pump according to claim 7 wherein the pressure compensation device further comprises:

a compensation pin and a lever, wherein the compensation pin is provided with a first end and a second end, the second end of the compensation pin exerting a force on the lever when the first end of the compensation pin is acted upon by a control pressure; and wherein the first pin is provided with a first end and a second end, the second end of the first pin exerting a force upon the lever when the first end of the first pin is acted upon by the pressurized fluid in the outlet chamber and wherein the second pin is provided with a first end and a second end, the first end of the second pin being in contact with the levers, the second end of the second pin being in contact with the inlet check valve, wherein the force from the compensation pin acting on the lever is balanced by the force from the first pin acting on the lever, and wherein an increase in pressure of the pressurized fluid in the outlet chamber above a preset level causes the first pin to exert a force on the lever that overcomes the force exerted by the compensation pin on the lever, thereby causing the lever to pivot and act upon the first end of the second pin, such that the second end of the second pin holds the inlet check valve open, thereby preventing the further pressurization of the fluid in the pressurization chamber.

9. The high-pressure pump according to claim 8 wherein the first pin passes through a compensator actuator cartridge that is sealingly engaged with the valve assembly, thereby preventing the leakage of pressurized fluid from the outlet chamber.

10. A high-pressure pump comprising:

a pressurization chamber;

a plunger coupled to the pressurization chamber for reciprocation within the pressurization chamber, the plunger having an intake stroke and a pumping stroke;

at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that fluid may pass from the pressurization chamber to the outlet check valve, the outlet check valve selectively allowing the pressurized fluid to pass to an outlet chamber; and a pressure compensation device coupled to the inlet check valve, the pressure compensation device having a first pin provided in direct contact with the pressurized fluid in the outlet chamber and being balanced against a control force, the pressure compensation device having a second pin, coupled to the inlet check valve and to the first pin, such that when a force generated by the pressurized fluid in the outlet chamber overcomes the control force, the first pin acts against the second pin such that the second pin holds the inlet check valve open, thereby preventing the further pressurization of fluid.

11. A high-pressure pump comprising:

a pressurization chamber;

a plunger coupled to the pressurization chamber for reciprocation within the pressurization chamber, the plunger having an intake stroke and a pumping stroke;

at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that fluid may pass from the pressurization chamber to the outlet check valve, the outlet check valve selectively allowing the pressurized fluid to pass to an outlet chamber; and a pressure compensation device coupled to the inlet check valve, the pressure compensation device having an outlet pin provided with a first end and a second end, the second end of the outlet pin exerting a force upon a lever when the first end of the outlet pin is acted upon by the pressurized fluid in the outlet chamber, the lever being also acted upon by the control force; and the pressure compensation device further being provided with an inlet pin having a first end and a second end, the first end of the inlet pin being in contact with the lever, the second end of the inlet pin being in contact with the inlet check valve, wherein the control force acting on the lever is balanced by the force from the outlet pin acting on the lever, and wherein an increase in pressure of the pressurized fluid in the outlet chamber above a preset level causes the outlet pin to exert a force on the lever that overcomes the control force, thereby causing the lever to pivot and act upon the first end of the inlet pin, the inlet pin including means for preventing the further pressurization of fluid.

12. The high-pressure pump according to claim 11 wherein the second end of the inlet pin forces the inlet check valve into an open position, such that the fluid in the pressurization chamber flows back out into the inlet area, thereby preventing the further pressurization of fluid.

13. A pressure compensation device for use in a high-pressure pump having a check valve assembly that selectively allows a volume of pressurized fluid to pass from a pressurization chamber to an outlet chamber, comprising:

an outlet pin having a first end and a second end, the second end of the outlet pin exerting a force upon a lever when the first end of the outlet pin is acted upon by the pressurized fluid in the outlet chamber;

a compensation pin having a first end and a second end, the second end of the compensation pin exerting a force on the lever when the first end of the compensation pin is acted upon by a control pressure; and an inlet pin having a first end and a second end, the first end of the inlet pin being in contact with the lever, the second end of the inlet pin being in contact with the inlet check valve, wherein the force from the compensation pin acting on the lever is balanced by the force from the outlet pin acting on the lever, and wherein an increase in pressure of the pressurized fluid in the outlet chamber above a preset level causes the outlet pin to exert a force on the lever that overcomes the force exerted by the compensation pin on the lever, thereby causing the lever to pivot and act upon the first end of the inlet pin, such that the second end of the inlet pin holds the inlet check valve open, thereby preventing the pressurized fluid from passing from the pressurization chamber to the outlet chamber.

14. The pressure compensation device according to claim 13, further comprising a compensator actuator cartridge having a sleeve provided with means for allowing the outlet pin to pass through it, wherein a tolerance between the outlet pin and the sleeve is minimized to prevent leakage of pressurized fluid from the outlet chamber.

15. The pressure compensation device according to claim 13 wherein the second end of the outlet pin is a first knife-edge bearing and the lever pivots about a second knife-edge bearing, thereby reducing friction.

16. The pressure compensation device according to claim 13 wherein the lever is configured such that the compensation pin, the outlet pin, and the inlet pin all act on a common center line of the lever.

17. The pressure compensation device according to claim 13 wherein the fluid pressure in the outlet chamber may be set to a user-selected level by adjusting the control pressure.

18. The pressure compensation device according to claim 13 wherein the lever is provided with an opening to receive the second end of the compensation pin and a diameter of the second end of the compensation pin is smaller than the opening in the lever and the compensation pin has an ability to flex such that when the lever pivots, the compensation pin does not slide in a lateral direction and friction between the compensation pin and the lever is reduced.

19. A method for controlling the output pressure of a positive displacement fluid pump, comprising:

drawing a volume of fluid into a pressurization chamber;

pressurizing the fluid by acting on the fluid with a reciprocating plunger;

selectively allowing the pressurized fluid to pass from the pressurization chamber to an outlet chamber;

balancing a force generated by the pressurized fluid in the outlet chamber against a control force via a pressure compensation device having a first pin positioned at least in part within the outlet chamber and a second pin coupled to the first pin and to an inlet check valve; and holding the inlet check valve open via the second pin when the force generated by the pressurized fluid overcomes the control force, thereby preventing the further pressurization of fluid.

20. A pressure compensation device for use in a high-pressure pump having a check valve assembly that selectively allows a volume of pressurized fluid to pass from a pressurization chamber to an outlet chamber via an inlet check valve and an outlet check valve, comprising:

a first pin positioned at least in part within the outlet chamber to sense a force generated by the pressurized fluid in the outlet chamber;

means for sensing a control force;

means for balancing the force generated by the pressurized fluid against the control force; and a second pin coupled to the inlet check valve and to the first pin such that the second pin holds the inlet check valve open when the force generated by the pressurized fluid overcomes the control force.

21. The pressure compensation device according to claim 20 wherein the control force is generated by a fluid control pressure.

22. The pressure compensation device according to claim 20, further comprising:

a lever that is acted upon by the force generated by the pressurized fluid in the outlet chamber via the first pin and that is acted upon by the control force, such that the lever is balanced when the pressure in the outlet chamber has not exceeded a desired level;

an inlet area via which fluid is introduced into the pressurization chamber; and wherein the lever rotates and acts upon the second pin which acts upon the inlet check valve when the pressure in the outlet chamber exceeds the desired level, thereby preventing the pressurization of the fluid.

23. A high-pressure pump comprising:

a pressurization chamber;

a plunger coupled to the pressurization chamber for reciprocation within the pressurization chamber, the plunger having an intake stroke and a pumping stroke;

at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that pressurized fluid may pass from the pressurization chamber to the outlet check valve, the outlet check valve selectively allowing the pressurized fluid to pass to an outlet chamber; and a pressure compensation device including an outlet pin having a first end and a second end, the second end of the outlet pin exerting a force upon a lever when the first end of the outlet pin is acted upon by the pressurized fluid in the outlet chamber, a compensation pin having a first end and a second end, the second end of the compensation pin exerting a control force on the lever when the first end of the compensation pin is acted upon by a control force, and an inlet pin having a first end and a second end, the first end of the inlet pin being in contact with the lever, the second end of the inlet pin being in contact with the inlet check valve, wherein the force from the compensation pin acting on the lever is balanced by the force from the outlet pin acting on the lever, and wherein an increase in pressure of the pressurized fluid in the outlet chamber above a preset level causes the outlet pin to exert a force on the lever that overcomes the force exerted by the compensation pin on the lever, thereby causing the lever to pivot and act upon the first end of the inlet pin, such that the second end of the inlet pin holds the inlet check valve open such that the fluid in the pressurization chamber flows back out of the pressurization chamber during the pumping stroke, thereby-preventing further pressurization of the fluid in the pressurization chamber.

24. A pressure compensation device for use in a high-pressure pump having a check valve assembly that selectively allows a volume of pressurized fluid to pass from a pressurization chamber to an outlet chamber, comprising:

an outlet pin having a first end and a second end, the second end of the outlet pin exerting a force upon a lever when the first end of the outlet pin is acted upon by the pressurized fluid in the outlet chamber;

a compensation pin having a first end and a second end, the second end of the compensation pin exerting a force on the lever when the first end of the compensation pin is acted upon by a control force; and an inlet pin having a first end and a second end, the first end of the inlet pin being in contact with the lever, the second end of the inlet pin being in contact with the inlet check valve, wherein the force from the compensation pin acting on the lever is balanced by the force from the outlet pin acting on the lever, and wherein an increase in pressure of the pressurized fluid in the outlet chamber above a preset level causes the outlet pin to exert a force on the lever that overcomes the force exerted by the compensation pin on the lever, thereby causing the lever to pivot and act upon the first end of the inlet pin, such that the second end of the inlet pin holds the inlet check valve open, thereby preventing the pressurized fluid from passing from the pressurization chamber to the outlet chamber.

25. The high-pressure pump according to claim 23 wherein the outlet pin passes through a compensator actuator cartridge that is sealingly engaged with the valve assembly, thereby preventing the leakage of pressurized fluid from the outlet chamber.

26. A high-pressure pump comprising:

a pressurization chamber;

a plunger coupled to the pressurization chamber for reciprocation within the pressurization chamber, the plunger having an intake stroke and a pumping stroke; at least one inlet port for introducing a volume of fluid into the pressurization chamber, the plunger drawing fluid into the pressurization chamber during the intake stroke and pressurizing the fluid on the pumping stroke;

a valve assembly having an inlet check valve and an outlet check valve, the valve assembly being coupled to the pressurization chamber such that pressurized fluid may pass from the pressurization chamber to the outlet check valve, the outlet check valve selectively allowing the pressurized fluid to pass to an outlet chamber; and a pressure compensation device coupled to the inlet check valve, the pressure compensation device comprising an outlet pin having a first end and a second end, the second end of the outlet pin exerting a force upon a lever when the first end of the outlet pin is acted upon by the pressurized fluid in the outlet chamber, a compensation pin having a first end and a second end, the second end of the compensation pin exerting a force on the lever when the first end of the compensation pin is acted upon by a control pressure, and an inlet pin having a first end and a second end, the first end of the inlet pin being in contact with the lever, the second end of the inlet pin being in contact with the inlet check valve, wherein the force from the compensation pin acting on the lever is balanced by the force from the outlet pin acting on the lever, and wherein an increase in pressure of the pressurized fluid in the outlet chamber above a preset level causes the outlet pin to exert a force on the lever that overcomes the force exerted by the compensation pin on the lever, thereby causing the lever to pivot and act upon the first end of the inlet pin, such that the second end of the inlet pin holds the inlet check valve open, thereby preventing the further pressurization of the fluid in the pressurization chamber.

27. The high-pressure pump according to claim 26 wherein the outlet pin passes through a compensator actuator cartridge that is sealingly engaged with the valve assembly, thereby preventing the leakage of pressurized fluid from the outlet chamber.

* * * * *

UNITED STATES PATENT AND TRADEMARK OFFICE

CERTIFICATE OF CORRECTION

PATENT NO. : 5,380,159
DATED : January 10, 1995
INVENTOR(S) : John H. Olsen, et. al.

It is certified that error appears in the above-indentified patent and that said Letters Patent is hereby corrected as shown below:

In column 9, claim 8, line 49, please delete "levers" and substitute therefor --lever--.

In column 10, claim 10, line 23, after "pin", please delete ",".

In column 13, claim 23, line 28, after "thereby" and before "preventing", please delete "-".

Signed and Sealed this

Twenty-fourth Day of October, 1995

*Attest:*

Bruce Lehman

BRUCE LEHMAN

*Attesting Officer*

*Commissioner of Patents and Trademarks*